United States Patent [19]

O'Rourke

[11] 4,124,316

[45] Nov. 7, 1978

[54] TOOTHBRUSH WITH DENTIFRICE ATTACHMENT

[76] Inventor: James L. O'Rourke, 6351 Memorial, Detroit, Mich. 48228

[21] Appl. No.: 704,333

[22] Filed: Jul. 12, 1976

Related U.S. Application Data

[63] Continuation-in-part of Ser. No. 646,501, Jan. 9, 1976, Pat. No. 4,049,354, which is a continuation-in-part of Ser. No. 506,009, Sep. 16, 1974, Pat. No. 3,936,200.

[51] Int. Cl.[2] ..... B43M 11/06

[52] U.S. Cl. ..... 401/184; 401/186; 401/276

[58] Field of Search ..... 401/184, 183, 186, 185, 401/152, 276, 156, 132–134

[56] References Cited

U.S. PATENT DOCUMENTS

| | | | |
|---|---|---|---|
| 1,504,143 | 8/1924 | Roberts | 401/152 |
| 3,319,837 | 5/1967 | Mueller | 401/183 X |
| 3,400,996 | 9/1968 | Vandergrift | 401/184 |
| 3,738,762 | 6/1973 | Moore et al. | 401/186 |

FOREIGN PATENT DOCUMENTS

| | | | |
|---|---|---|---|
| 1,266,628 | 3/1972 | United Kingdom | 401/183 |

*Primary Examiner*—Stephen C. Pellegrino

[57] ABSTRACT

A toothbrush having a brushing unit and a dentifrice containing cartridge unit. The cartridge unit is shaped to permit it to be comfortably held in the hand and has a squeezable wall for the purpose of expelling dentifrice from the dentifrice-containing chamber therein. The dentifrice passage extending from the chamber to the brushing unit is normally closed by a valve which opens by the force of the dentifrice when the cartridge is squeezed. A check valve permits air to replace dentifrice that has been expelled from the cartridge chamber. The dentifrice may be introduced directly into the cartridge chamber, or it may be placed in a bag or tube and the dentifrice-containing bag or tube placed in the chamber. The bag or tube may have screw threaded or slip on type openings at one or both ends or one or both ends may be pierced by a needle or the like to allow the dentifrice to be squeezed out.

7 Claims, 17 Drawing Figures

TOOTHBRUSH WITH DENTIFRICE ATTACHMENT

REFERENCE TO RELATED APPLICATIONS

This application is a continuation-in-part of my application Ser. No. 646,501, filed Jan. 9, 1976, now U.S. Pat. No. 4,049,354, which is a continuation-in-part of my application Ser. No. 506,009, filed Sept. 16, 1974 and now Pat. No. 3,936,200.

BACKGROUND AND SUMMARY OF THE INVENTION

A primary object of the invention is to provide a toothbrush which has a cartridge for holding dentifrice to be used in the brushing operation. The cartridge, which serves also as a handle portion, is an elongated unit which fits comfortably in the hand. It has a flexible wall which when squeezed forces dentifrice to the brush head.

A further object of the invention is to provide a thin walled bag or tube for containing dentifrice which may be introduced into the cartridge. The bag or tube may be thrown away after the dentifrice is used up and replaced by another, without requiring replacement of the entire cartridge unit. The tube or bag may be of a suitable thin walled plastic construction, and may be pierced by a needle or like piercing element in the cartridge unit when ready for use. Alternatively, the bag or tube may be provided with a threaded or slip on type opening through which the dentifrice is dispensed.

A further object of the invention is to provide a bag or tube for insertion in the cartridge unit which is constructed so as to protect the dentifrice from contamination with the ambient air or with any other contaminant. In this connection, the air which enters the cartridge unit after squeezing to replace the expelled dentifrice nevertheless is separated from the interior of the dentifrice-containing bag or tube so as to protect the dentifrice at all times from contamination.

Other features of the invention include the provision of check valve means permitting air to fill the space in the cartridge after some of the dentifrice has been used, so that the cartridge will return to its original shape after squeezing.

Other objects and features of the invention will become more apparent as the description proceeds especially when taken in conjunction with the accompanying drawings wherein.

Figure 1:
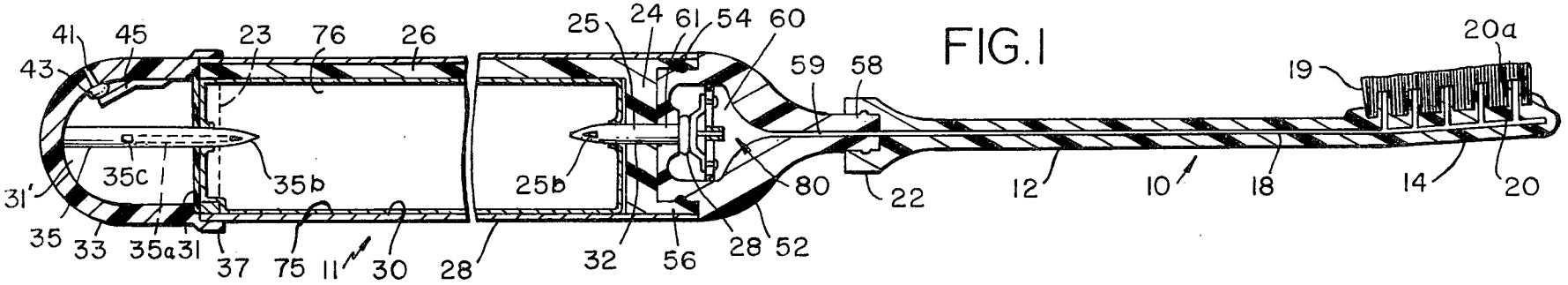
FIG. 1 is a longitudinal sectional view of a toothbrush with a dentifrice holder or cartridge constructed in accordance with my invention.
Figure 2:
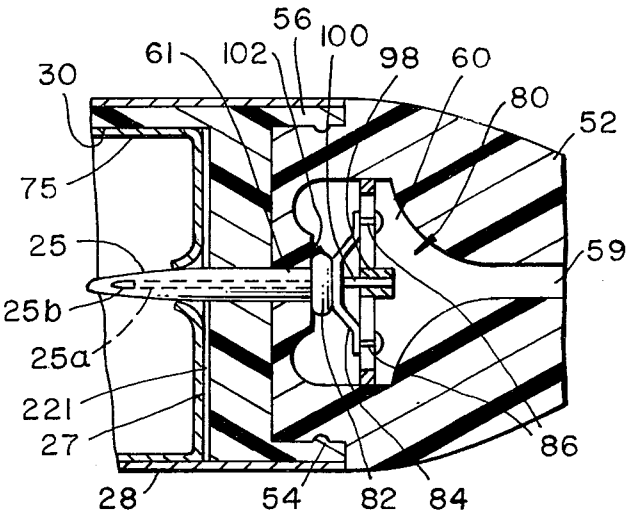
FIG. 2 is an enlarged sectional view of a portion of FIG. 1, showing the valve mechanism for controlling the passageway from the dentifrice chamber to the brush head and also showing a piercing element for opening the end of the dentifrice containing tube or bag.
Figure 3:
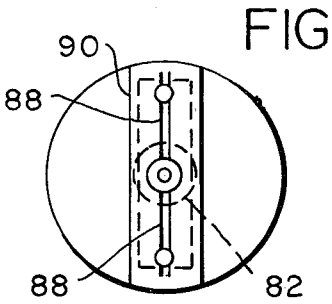
FIG. 3 is an elevational view of the valve mechanism shown in FIG. 2.
Figure 4:
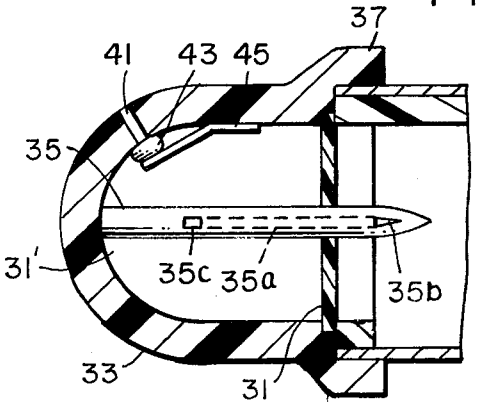
FIG. 4 is an enlargement of the cap end portion of the device, omitting the dentifrice tube.

Referring now more particularly to the drawings and especially to FIGS. 1 to 3 thereof, the toothbrush assembly there shown will be seen to comprise a brushing unit 10 and a cartridge unit 11 which serves also as a handle portion for the assembly.

The brushing unit includes an elongated shank 12 having a brush head 14 at one end provided with a dense multiplicity of brushing bristles 19 projecting from the head laterally with respect to the longitudinal center line of the shank. These bristles may be of the ordinary type used in the standard toothbrush for brushing the teeth.

A central dentifrice passage 18 runs substantially the full length of the shank having ports 20 opening through the surface of the brush head at the base of the bristles to deliver dentifrice through the tube or tubes **20*a* which are secured to the brush head and extend from the passages 20 parallel to and interspersed among the bristles 19 of the brush head 14. The dentifrice squeezed from the cartridge unit as explained more fully hereinafter, is thus discharged from the open outer ends of the tubes 20*a* at or near the brushing ends of the bristles. These tubes may preferably be of a flexible resilient material such as rubber or plastic. The bristles extend beyond the discharge ends of the tubes 20*a*** as shown but could be flush with the discharge ends.

The end of the shank 12 opposite the head 14 is enlarged slightly to provide an internally threaded socket 22. The shank 12, including its head 14 and socket 22 is substantially rigid and formed of any suitable material such as one of the well known plastics.

The cartridge unit or handle portion 11 is an elongated member having a circular head 24 at one end and having an integral, relatively rigid spine 26 extending lengthwise thereof from the head. A rigid ring 23, relatively thin in cross section, is integral with the spine 26 at the end thereof opposite head 24 and concentric with the head. The head 24 has a needle or piercing element 25 secured in a central hole therein on the center line thereof. The needle 25 projects beyond the head at both ends. It has a passage **25*a* opening through ports 25*b* in the pointed or piercing end of the needle. The passage opens through the opposite end of the needle. The spine 26 is of fairly limited circumferential extent and is provided to give a substantial degree of strength and rigidity to the handle portion so that the handle portion may be firmly and comfortably held in the hand while brushing the teeth. The circumferential extent of the spine however is not critical. The material from which the head 24 and spine 26 are made may be the same as that for the shank 12**.

An elongated flexible cylinder 28 surrounding the head 24, spine 26 and ring 23 is permanently secured thereto by any suitable means as by a suitable adhesive. This cylinder 28 defines a chamber 30 for a liquid dentifrice or liquid dentifrice-containing bag or tube 75 and may be likened to a bulb on the end of a syringe in that it is self shape-sustaining and will return to the illustrated position after being squeezed. The tube 28 may be of any flexible resilient shape-sustaining material capable of being squeezed such for example as rubber or plastic. The head 24 is at one end of the cylinder 28 and the flat transverse wall 27 of the head 24 defines the end of chamber 30. The opposite end of the cylinder 28 is open. A dome-shaped cap 33 has a circular rim 37 which fits over the open end of the cylinder and is held thereto either by a threaded connection or by a tight slip fit, to close chamber 30. A slip fit is shown. The ring 23 of the handle portion 11 provides internal support for the cap when the tube 28 is squeezed. A disc 31 is secured to and extends across the open end of the cap to define a closed or sealed chamber. A needle 35 is secured at one end to the base of the cap and extends on the center line of the cap through a center hole in the disc 31, terminating in a pointed end beyond the circular rim of the cap. A passage 35*a* extends lengthwise through the needle having ports 35*b* and 35*c* at the ends of the passage. Port 35*b* is near the pointed end of the needle outside the disc 31 and port 35*c* is at the inner side of the disc so as to be inside the cap. An air passage 41 in the wall of the cap is normally closed by a check valve 43 urged to closed position by the spring 45.

A coupler 52 between the brushing unit 10 and the cartridge unit 11 may be considered as a part of either unit. It has a threaded connection indicated at 54 with a cylindrical extension 56 of the cartridge head 24 and it also has a threaded connection in the socket 22 of the toothbrush shank 12. The coupler 52 has a passage 59 which opens into a valve chamber 60, the passage 59 being in direct communication with the passage 18 in the toothbrush shank 12. The coupler 52 also has a central opening 61 extending from the chamber 60 which has a close fit with the end of the needle 25 projecting from the head 24 of the cartridge unit. Accordingly the passage in needle 25, chamber 60 and the passage 59 provide communication from the chamber 30 of the cartridge unit to the longitudinal passage 18 in the toothbrush.

The valve chamber 60 in the coupler 52 houses the valve mechanism 80 for controlling the flow of dentifrice from the cartridge unit through the coupler to the toothbrush. The valve mechanism comprises a valve element 82 which is permanently secured to an elongated leaf spring 84 about midway between the ends thereof. Pins 86 projecting from the end portions of the leaf spring slide in slots 88 formed in the plate 90 of the valve mechanism. This plate 90 extends across the valve chamber 60 and is secured to the opposite side walls thereof. A cylinder 98 on the plate 90 guides the sliding movement of a plunger 100 on the back of the leaf spring 84.

The leaf spring 84 normally assumes the FIG. 2 position and thus urges the valve element 82 to the closed position against the end of needle 25, thus closing the needle passage. When however the dentifrice is squeezed from the cartridge unit, the internal force unseats the valve element 82. Unseating of the valve element is accompanied by a flattening of spring 84 and a sliding of pins 86 in slots 88. Dentifrice can flow past the unseated valve element 82 around the valve mechanism and through the passages 59 and 18 to the head of the toothbrush. When dentifrice is no longer being forced from the cartridge unit, the valve element 82 returns by spring pressure to the normally closed FIG. 2 position.

One method of manufacturing the coupler 52 in a manner permitting the valve mechanism 80 to be assembled is to mold the coupler in two longitudinal halves, the split between the halves occurring in the plane of the section shown in FIG. 1. The valve mechanism 80 may then be inserted into one of the halves and secured to the opposite walls after which the two halves are secured together by any suitable means such as adhesive or the application of heat. This is just one way in which the coupler may be constructed so as to permit assembly of the valve mechanism.

The chamber 30 of the cartridge is intended to receive a bag or tube 75 filled with liquid dentifrice 76. This bag or tube initially is a closed elongated cylindrical sausage-shaped container of very thin wall construction. The material of the bag or tube 75 may be of thin rubber or plastic or other flexible resilient material. Its ends are preferably of the same material as the rest of the bag or tube but these ends in particular must be sufficiently thin walled to be capable of being pierced by a sharp needle or piercing element. Actually the ends may be of a different or thinner material than the rest of the tube or bag so as to be capable of being pierced.

This bag or tube 75 when filled to capacity with dentifrice is the same diameter or slightly smaller than the chamber 30, and the ends are dome-shaped or hemispherical. The filled tube 75 before insertion in the cartridge is longer from one domed end to the other than the length of the cartridge 30 measured between the end face 27 of the head 24 and the disc 31 of the cap.

In order to insert the dentifrice-filled tube in the cartridge, the cap 33 is removed and the tube is slipped endwise into the open end of the chamber 30. The tube, being slightly smaller in diameter than the chamber 30, slips in easily. The tube may be squeezed slightly to clear ring 23. Its inserted end is pierced by the sharp point of the needle 25 and continued slight manual pushing pressure on the protruding end of the tube causes the inserted end to ultimately flatten out against the face 27 of the head 24 as seen in FIG. 1. It will be understood that during this time of insertion, the tube may be inserted easily and in fact merely dropped into the chamber if the toothbrush assembly is held upright requiring only slight additional manual pressure to pierce the inserted end of the tube by the needle. For this purpose, the needle may be very sharp and as stated above the end of the tube is very thin walled and easily pierced. Also, the tube is filled with dentifrice to bulging, so that the needle easily pierces the tube end.

After the tube is fully inserted, its outer dome-shaped end protrudes beyond the open end of the chamber 30. When the cap 33 is installed over the open end of the chamber, with its rim 37 either slip fitted over or screwed on the cylinder 28, needle 35 pierces the other end of the tube and disk 31 flattens it to the position shown in FIG. 1. The tube is thus flattened at both ends causing its cylindrical side wall to bulge into contact with the cylinder 28. The wall 27 of head 24 may have radial grooves 221 to grip the tube 75 and prevent it from rotating if the cap is of the screw-on type.

As seen in FIG. 1, the ports 25*b* and 35*b* in the pointed ends of the needles are now inside the dentifrice tube 75. When the cartridge is squeezed by placing the palm of the hand around the tube 28 between head 24 and cap 33, dentifrice in the bag 75 may enter needle 25 through port 25*b*. No appreciable amount of dentifrice will enter needle 35 because the cap chamber 31' is a closed chamber which will build up air pressure to resist the entry of dentifrice when the cartridge is squeezed. The dentifrice that enters the needle 25 through port 25*b* by reason of the squeezing pressure unseats the valve 82 to pass through the coupler passage 59 and into the toothbrush to be dispensed upon the bristles 16. The cap 33 is internally supported by ring 23 during squeezing of the cartridge.

When the squeezing pressure is released, the cylinder 28 returns to its illustrated position and valve 82 closes by spring pressure. The resulting reduced pressure inside cap 33 causes check valve 43 to open against the pressure of spring 45 to replace dentifrice expelled from the tube 75 with air. Accordingly, the used dentifrice will be replaced by air entering the tube 75 through the port 41 in the cap and the needle passage 35*a* after each squeezing. The tube 75 will thus continue to maintain its full expanded position shown in FIG. 1 even after most or all of the dentifrice has been used up, because the dentifrice is replaced by air.

After all of the dentifrice has been dispensed, the cap 33 may be removed, the tube 75 thrown away and replaced by another filled tube.

Figure 5:
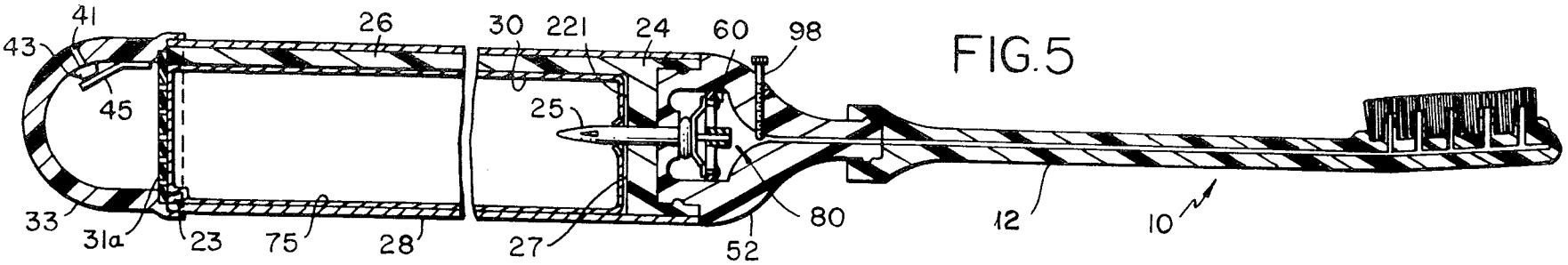
FIG. 5 is a longitudinal sectional view of a toothbrush having a modified construction.
Figure 6:
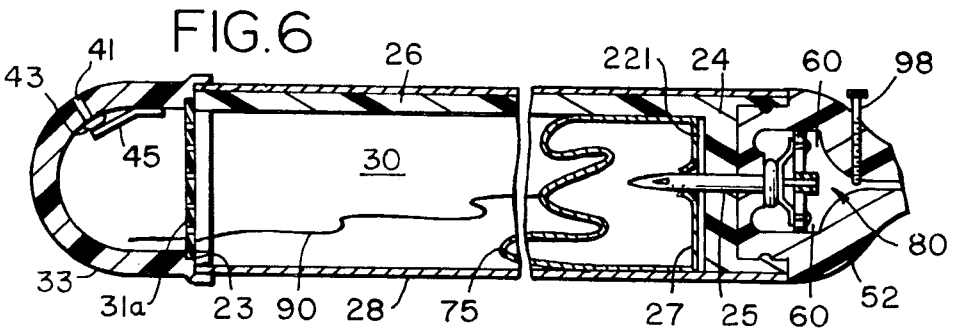
FIG. 6 is a fragmentary longitudinal sectional view of the cartridge unit of the toothbrush of FIG. 5 showing the dentifrice tube partially collapsed.

FIGS. 5 and 6 illustrate a modification of FIGS. 1–4 in which corresponding parts are identified by the same reference numerals. The device of FIG. 5 differs in that the cap 33 has a perforated disc 31*a* instead of the imperforate disc employed in the device shown in FIG. 1 and in that the needle is omitted. Otherwise the cap 33 is like that shown in FIG. 1.

The dentifrice tube or bag 75 is like the one previously described. It differs only in that it has a string 90 on the end near the cap which is used to pull out and remove a used-up tube.

The operation of the device in FIG. 5 is slightly different in that no air enters the tube or bag 75. Hence the dentifrice within the bag is sealed and protected against contamination from air or other foreign matter.

When the wall or cylinder 28 of the device in FIG. 5 is squeezed, dentifrice is expelled from the bag through the needle 25 to the brushing bristles in the same manner as previously described in connection with FIG. 1. When the squeezing pressure is released to allow the cylinder 28 to return to the illustrated position, the bag 75 begins to wrinkle up and the reduced pressure causes air to enter through port 41 in the cap to replace the volume of dentifrice dispensed. After repeated squeezing of the cartridge, the bag 75 wrinkles or shrivels up to the FIG. 6 position, the space at the cap end of the cartridge being filled with replacement air drawn in through the port 41 and of course through the perforations in the plate 31*a*. After all of the dentifrice has been used up, the cap is removed, the used-up bag is pulled out by the string 90 and a new dentifrice-filled bag is replaced.

The assembly shown in FIGS. 5 and 6 also has a needle valve 98 which is an elongated screw threaded member, threaded laterally into the coupler 52 at the throat between the valve chamber 60 and the passage 59 to reduce or restrict the cross section at the throat and thus limit the amount of dentifrice that can be squeezed out. By adjusting the needle valve 98 threadedly in and out the amount of restriction can be varied. This needle valve 98 can of course also be used in any of the other embodiments disclosed herein.

Figure 7:
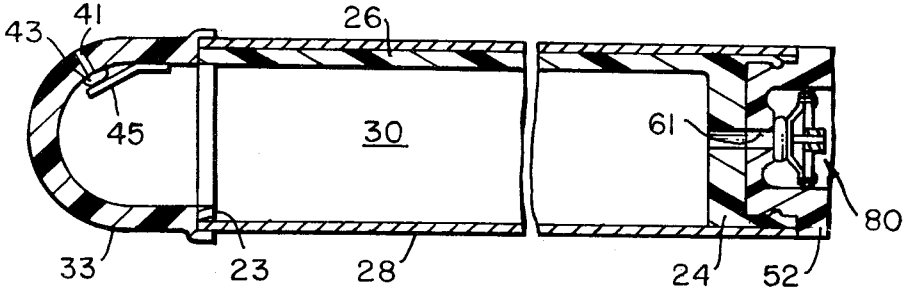
FIG. 7 is like FIG. 6 but shows still another form of the invention.

FIG. 7 shows a further modification of the invention in which the needle 25 is omitted and no disk 31 or 31*a* is required in the cap. In this form of the invention, the dentifrice is simply poured into the chamber 30 of the cartridge without having it contained in a bag. Squeezing of the wall 28 causes the dentifrice to flow to the toothbrush past the valve mechanism 80 as heretofore described and upon release of squeezing pressure the used dentifrice replaced by air drawn through the check valve 41.

Figure 8:
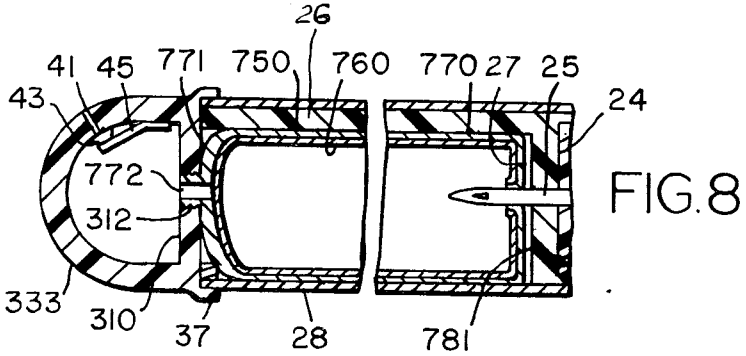
FIG. 8 is like FIGS. 5 and 6 but shows a still further modification.

FIG. 8 shows a further modification in which the cap 333 and dentifrice tube or bag 750 are of modified construction. The cap in place of the disc 31 or 31*a* has a wall 310 with a central threaded opening 312. The bag 750 has an inner tube 760 and an outer tube 770. The inner tube is an elongated cylindrical closed container similar to the container 75 previously described which is initially filled with liquid dentifrice. The outer container 770 is of substantially the same material and construction as the inner tube, but has a thickened wall portion at one end where indicated at 771 provided with a threaded central extension 772. Extension 772 is initially closed by a cap which is removed after the tube 770 is installed in the cylinder 28 but before cap 333 is applied. Preferably the ends of the inner and outer tubes 760 and 770 opposite the threaded extension 772 are secured together. In the initial condition of the filled tube 750, it may have a slightly smaller diameter than the cylinder 28 but is of a greater length than the distance between the wall 27 of head 24 and the wall 310 of the cap when the cap is fitted over the open end of the cylinder 28. These ends of the tube may be dome-shaped as was the case with the previously described container 75.

The slightly smaller outside diameter of the tube 750 in its free state condition allows it to be slipped easily lengthwise into the cylinder 28 and slight manual pressure is all that is necessary to cause the needle 25 to pierce the end walls of the inner and outer tubes 760 and 770 as shown in FIG. 8. The bag or tube being filled to bulging with dentifrice initially, as is the bag 75 previously described, the needle 25 will pierce both inner and outer tube end walls readily as the tube 750 is inserted.

When the cap 333 is applied it is rotated at first to form a threaded connection between the extension 772 and the central opening in wall 310 and then, either by continued rotation if a threaded connection or a straight press if a slip fit, the cap flange 37 is secured over the end of the cylinder 28 in the position illustrated in FIG. 8 while the wall 310 of the cap compresses the tube 750 in an endwise direction so that the ends of the tube are flattened as shown. The end wall 27 of head 24 may have radial grooves 781 which when contacting the end wall of the tube will resist tube rotation when the cap is threaded on.

In use, when the cartridge is squeezed, dentifrice is forced out of the inner tube through the needle 25 to the brushing head as before. Air entering through port 41 when squeezing pressure is released enters the space between the tubes 760 and 770 to take the place of the inner tube as it collapses but does not contaminate the dentifrice which remains sealed within the inner tube.

When the dentifrice is used up the cap is removed and the used-up tube 750 replaced. It will be understood that the tube 750 before being installed in the cartridge will normally have a closure cap over the extension 772 which is removed prior to installation in the cartridge.

Figure 9:
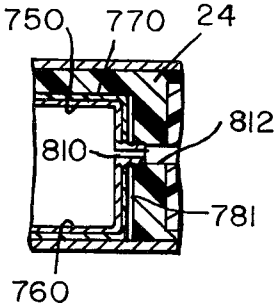
FIG. 9 is a fragmentary sectional view showing a modification of FIG. 8.

FIG. 9 shows a modification of the invention in which the lower end portion of the bag 750 has a threaded extension 810 which is at all times in communication with the interior of the inner tube 760 through openings in the end walls in the inner and outer tubes. This extension 810 is initially closed by a cap which is removed prior to installation in the cartridge. The needle 25 is not employed in the FIG. 9 embodiment and the central passage 812 in head 24 is threaded so as to threadedly receive the extension 810 when the dentifrice filled tube 750 is introduced with a rotating motion. Otherwise the structure of FIG. 9 is like that shown in FIG. 8.

Figure 10:
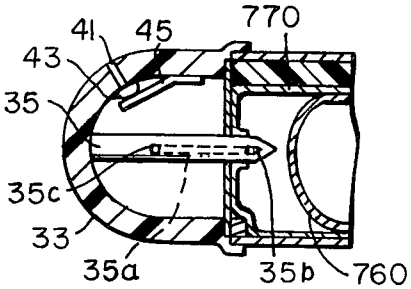
FIG. 10 is a fragmentary sectional view showing a further modification of FIG. 8.

FIG. 10 shows a further modification of FIG. 8 in which the cap employed is the cap 33 previously described in connection with FIG. 1, having the needle 35 which is intended to pierce the end wall of the outer tube only when the cap is applied. The adjacent end wall of the inner tube 760 is far enough axially removed not to be touched by the needle when the cap is applied. Entrapped air between the tubes holds the outer tube 770 expanded for piercing. Of course this end wall of the outer tube 770 which is pierced by the needle 35 must be sufficiently thin to allow piercing and it does not have the threaded extension 772. When the wall 28 is squeezed dentifrice is forced out to the brush head as before and when squeezing pressure is released air introduced through port 41 will enter the space between the tubes 760 and 770 through the needle 35.

It will be understood that the construction of FIG. 8 may be modified by the structure of FIG. 9, or by the structure of FIG. 10, or by the structure of both FIGS. 9 and 10.

Figures 11, 12, 13, 14, 15, 16, 17:
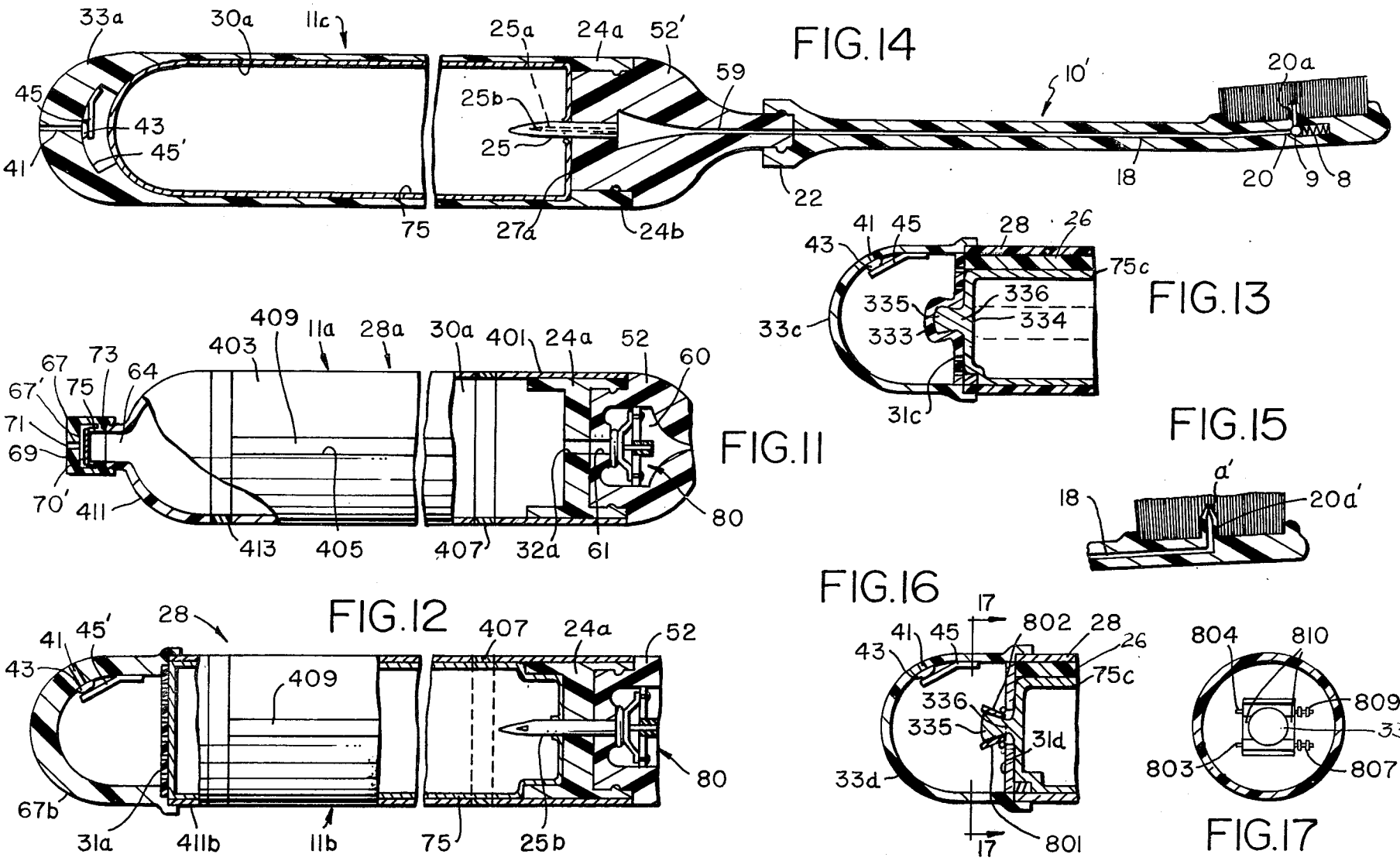
FIG. 11 shows a further modification.
FIG. 12 is like FIG. 11 but shows still another modification.
FIG. 13 is a fragmentary view showing a modification of FIG. 5.
FIG. 14 shows another modification.
FIG. 15 shows still another modification.
FIG. 16 is a modification of FIG. 13.
FIG. 17 is a sectional view on the line 17—17 in FIG. 16.

FIG. 11 shows a further modification in which as in FIG. 7, the dentifrice is poured into the chamber of the cartridge unit without providing a bag or tube to contain the dentifrice.

The brushing unit is the same as in previous embodiments and is connected to the cartridge unit by a similar coupler 52 having the valve mechanism 80 in the coupler chamber 60.

The cartridge unit **11*a* is considerably different from those cartridge units previously described. It has a circular head 24*a* which is like the head 24 described in previous embodiments but lacking the previously described spine. The head has a central passage 32*a* which communicates with the passage 61** in the coupler for dispensing dentifrice through the coupler to the brushing unit as in previous embodiments. The head is substantially rigid and formed of any suitable material such as any one of the well known plastics.

An elongated cylindrically shaped cylinder **28*a* defines the liquid dentifrice chamber 30*a*. The cylinder 28*a* includes a cylindrical section 401 which snugly fits over the head 24*a* and is permanently secured thereto by any suitable means as by a suitable adhesive. The cylinder 28*a* also includes a cylindrical section 403 which is longitudinally split where indicated at 405. The section 403 is of the same diameter as the section 401 and is disposed in substantially end-to-end continuation thereof, being connected thereto by a ring of sponge or foam rubber 407 or other similar readily flexible, stretchable and compressible material. The sections 401 and 403 are of the same substantially rigid material as the head 24*a*, although the section 403 has enough flexibility to enable it to be squeezed so as to cause its adjacent edges across the gap 405 to approach one another and dispense dentifrice. The adjacent edges of the section 403 across the gap 405 are connected by a strip of sponge or foam rubber or similar material 409 like the material of the ring 407 to permit the edges of the section 403** to approach one another when the section is squeezed.

The end of the cylinder **28*a* is closed by a dome-shaped hollow section 411 of the same material as the sections 401 and 403 connected to the end of the section 403 by a ring 413** of foam rubber or similar material.

The sponge or foam rubber strip 409 closing the gap between the edges of the split cylinder 403 is provided to close the chamber and also to permit squeezing of the section 403 to dispense dentifrice. The gap 405 between the edges of the split cylinder section 403 may be increased in width to allow a greater amount of dentifrice to be dispensed by squeezing. The rings 407 and 413 complete the enclosure of the chamber **30*a* and permit flexing of the section 403 independently of the end sections 401 and 411 of the cylinder 28*a***.

A cap 67 threads on the fill opening 64 in the neck on the dome-shaped section 411 of the cylinder. A check valve is provided in the cap to admit air to the chamber **30*a* when squeezing pressure is released. The check valve comprises a valve disc 70' which lies loosely within the bottom of the cap in an enlarged chamber 67'. The valve disc when there is internal pressure in the chamber 30*a* due to squeezing of the cylinder section 403, is forced by internal pressure against the base 69 of the cap to close the air inlet 71. Circumferentially spaced spring elements 75 lightly press against the valve disc to hold it normally in closed position over the air inlet port. Reduction in internal cartridge pressure which occurs when squeezing is released causes the valve disc 70' to move away from and open the inlet 71 against the action of the springs 75. The incoming air can bypass the valve disc which is held away from the internal shoulder 73 in the cap by the springs 75**.

In use, when the cylinder section 403 is squeezed, dentifrice is forced through the passages **32*a* and 61 to the brushing unit. No dentifrice can escape the check valve in the cap. When squeezing pressure is released air is admitted by the check valve in the cap to replace the dentifrice expelled. The size of the gap 405 between the edges of the split cylinder section 403** determines the amount of dentifrice that can be dispensed with each squeezing. Hence the amount of dentifrice dispensed with each squeezing is a metered amount.

It will be understood that the section 403 can be replaced by separate arcuate sections of about 180° in circumferential extent, having gaps at their adjacent edges closed by sponge or foam rubber strips like strip 409.

FIG. 12 shows a modification of the FIG. 11 construction in which the cartridge unit **11*b* is exactly the same as the cartridge unit 11*a* with the exception that the end section 411*b* instead of being dome-shaped like the end section 411 in FIG. 11 is of cylindrical form having an open end, and that a cap 67*b* of different construction is provided, and that a piercing needle 25*b* is provided like the needle 25 shown for example in FIG. 1, such needle being carried by coupler 52 having the previously described valve 80 controlling dentifrice flow to the toothbrush. The cartridge unit of FIG. 12 is adapted to be used with a bag or tube of the liquid dentifrice similar to the bag or tube 75 shown in FIG. 1 and bearing the same reference numeral in FIG. 12. As previously stated, this bag or tube 75 is initially a closed, elongated cylindrical sausage-shaped container of very thin wall rubber or plastic or other flexible resilient material capable of being readily pierced by the needle when inserted in the chamber 30***a*. The ends of the bag 75 are as previously stated dome-shaped in the initial condition of the bag in which it is filled with dentifrice before insertion in the chamber.

The cap 67*b* is substantially the same as the cap 33 in FIG. 5 having the air inlet 41, the valve 43 and the leaf spring 45 which normally holds the valve closed. This is a check valve to permit the inflow of air but to prevent the outflow. The cap has the perforated plate 31*a* across its open end. The cap is fitted on the end section 411*b* of the cartridge cylinder with a threaded or slip fit.

In order to insert the dentifrice filled bag 75 in the cartridge, the cap 67*b* is removed and the bag slipped endwise into the open end of the chamber. The bag is slightly smaller in diameter than the chamber so that it slips in easily. Its inserted end is pierced by the sharp point of the needle 25. Its opposite end protrudes beyond the end section 411*b* of the chamber defining cylinder so that the protruding end is pressed flat when the cap is applied as in FIG. 12.

When the cylinder is squeezed dentifrice is forced from the bag 75 through the needle 25*b* to the brushing unit. Upon the release of squeezing pressure, air is admitted through the port 41 in the cap to collapse the bag similar to the manner in which that function is accomplished in FIGS. 5 and 6.

FIG. 13 shows a modification of FIG. 5 in which the cap 33*c* and the dentifrice-containing bag 75*c* are of somewhat different construction. The cartridge 11 is the same as in FIG. 5.

The cap 33*c* has the air intake port 41, the check valve 43 and the leaf spring 45 normally closing the check valve. The perforated plate 31*c* differs from the perforated plate 31 in that it has a central bulb-shaped configuration designated 333 which has a narrow neck portion 334.

The bag 75*c* is like the bag 75 disclosed in FIG. 5 except that the end adjacent to the cap has a solid thickened knob 335 which has a narrow connecting portion 336 where the knob joins the end of the bag. This knob 335 and the connecting portion 336 are complementary in shape and size to the recess in the bulb 333.

Before the cap is applied, the end of the bag 75*c* is somewhat dome-shaped and protrudes beyond the open end of the cylinder 28. When the cap is applied the plate 31*c* which flattens the end of the bag 75*c* also causes the knob 335 to be forced into the bulb 333 where it is retained in the applied position of the cap as shown in FIG. 13.

When the dentifrice is used up by squeezing the cylinder 28, as described previously in connection with FIG. 5, the bag 75*c* collapses to the dotted line position shown, although the knob 335 remains held in the bulb 333 so that when the cap is removed the bag 75*c* is automatically pulled out of the cylinder 28 after which it can be separated from the cap by pulling the bag 75*c* to remove the knob 335 from the bulb 333.

It will be understood that other means may be employed to secure the end of the bag 75*c* to the cap instead of the knob 335 and bulb 333 although this expedient is considered to be an extremely efficient construction. For example, the end of the bag 75 in FIG. 5 may simply be attached by adhesive to the flat plate 31.

FIG. 14 shows a modification in which the brushing unit 10' differs from the brushing unit 10 disclosed in FIG. 1 in that only a single tube 20*a* is shown extending from the port 20 which connects it to the central dentifrice passage 18. In addition, a check valve in the form of a ball 9 is employed to normally close the port 20 by the pressure of spring 8. When dentifrice is forced through the passage 18 by squeezing of the cartridge unit 11*c* described hereinafter, the pressure of the dentifrice will open the check valve to deliver dentifrice to the bristles through tube 20*a*. When the squeezing pressure is released, the check valve closes. In this way the passage 18 in the shank of the brushing unit is kept free of contamination through reverse flow of water and saliva.

The tube 20*a* is shown positioned between the ends of the cluster of bristles and terminating below the tops of the bristles. This tube could of course extend up flush with the tops of the bristles. It could also be located at either end of the cluster of bristles or to the side depending upon particular preferences.

The coupler 52' differs from the coupler 52 previously described primarily in that it does not have a valve mechanism disposed in it. In effect, the check valve 9 in the brushing unit 10' serves the function of the valve 80. The coupler 52', like the coupler 52, has a passage 59 and a piercing element or needle 25. The needle 25, as before, has a sharp point projecting beyond the end 27*a* of the coupler and is provided with a central passage 25*a* and port 25*b* for communication with the passage 59 which also communicates with the passage 18 in the brush unit across the threaded connection between the socket 22 of the brush unit and the narrow end portion of the coupler.

The cartridge unit or handle portion 11*c*, like the cartridge unit 11, is an elongated member but in this instance is of one-piece construction. It is in the form of an elongated flexible cylinder which is open at the end connected to the coupler and closed at the opposite end 33*a*. The opposite end 33*a* corresponds to the cap 33 previously described and in effect constitutes an integral cap. Actually the entire cartridge unit 11*c* including the cylindrical portion and cap end portion may be considered as a one-piece cap structure. The chamber within the cylinder of the cartridge unit is designated 30*a* and is an elongated chamber adapted to receive the bag or tube 75 which contains the dentifrice. The open end of the cartridge unit is shown as being somewhat thickened where indicated at 24*a*. Although this thickening is not necessary it provides a more secure connection to the coupler which may be a threaded connection or a simple slip-on connection. As shown, the thickened portion 24*a* has an annular bead 24*b* fitting in a complementary annular groove in the coupler so that the open end of the cartridge unit can simply be expanded somewhat so that the bead 24*b* clears the end of the coupler, then slid axially over the coupler until the bead 24*b* snaps into the groove.

FIG. 14 shows the cartridge unit assembled on the coupler with the one domed end of the bag 75 conforming to the domed end of the chamber 30*a* adjacent the cap portion 33*a*, and the opposite end of the tube 75 pressed flat against the end face 27*a* of the coupler 52'. It will be understood that the tube 75 of dentifrice is filled to bulging so that both ends are initially dome-shaped but that the one end is pressed flat when assembled with the coupler. During such assembly operation, the pointed needle 25 pierces the end of the tube 75 to open the passageway from the interior of the tube 75 to the brushing unit.

In the cap end 33a of the cartridge unit, there is the port 41 having the valve element 43 which normally closes the port by the pressure of spring 45. This valve element and spring are confined in a narrow recess 45' in the cap end portion 33a, such recess being relatively narrow so that the adjacent end of the tube 75 will not squeeze into and interfere with the operation of the valve mechanism.

The material of which the cartridge unit 11c is made may be the same as that material selected for the cylinder 28 previously described. Thus the wall of the cylindrical portion thereof is self shape-sustaining but squeezable and will return to the illustrated position after being squeezed.

In use, the dentifrice is squeezed out of the tube 75 by squeezing pressure on the cartridge unit, and when squeezing pressure is released the cartridge unit will return to the illustrated position but the bag 75 will gradually collapse, similar to the collapse of the bag described and illustrated in connection with FIG. 6, air being drawn in through the port 41 by the reduced air pressure in the cartridge to replace the volume or space previously occupied by the tube 75.

When the dentifrice is substantially all used up, the cartridge is removed from the brushing unit and the bag 75 removed from the open end and replaced by a full bag.

As stated above, the entire cartridge unit 11c may be considered as a one-piece cap structure having some sort of connection to the coupler such for example as a threaded connection or a simple slip-on connection. It should be understood that in the modification of FIG. 14 the dentifrice tube 75 may be omitted and instead the dentifrice may be poured directly into the chamber. The dentifrice may be introduced into the chamber while the cartridge is held with its open end up, after which the coupler is attached. When no tube 75 is employed the piercing element 25 of course is unnecessary. Without the tube 75, and without the piercing needle, the construction in FIG. 14, at least insofar as the cartridge unit is concerned, is similar to the construction in FIG. 7 except of course in FIG. 7 a separate cap is employed.

FIG. 15 shows a modification of a portion of FIG. 14 in which the tube 20a' has its discharge end *a'* flattened as indicated to provide a normally closed outlet valve. Tube 20a' is shown within the cluster of bristles but could also be at either end or to the side if desired. It should be at least adjacent to the bristles. This tube 20a' is like the tube 20a, of rubber or like flexible material, but the integral discharge valve *a'* at the end of the tube 20a prevents altogether any contamination of the dentifrice inside the passages of the toothbrush by reverse flow. Normally the lips forming this discharge valve *a'* close and seal against one another so that no backflow is possible. Internal pressure created by the squeezing of the cartridge to force dentifrice through the passage 18 into the tube 20a will cause the lips of the valve *a'* to separate and open permitting the dentifrice to flow out onto the bristles. When the squeezing pressure is released the valve *a'* will immediately close. In this modification of the invention, the valve 9 and spring 8 shown in FIG. 14 are of course omitted as being unnecessary. The valve 9 in FIG. 14 while it prevents contamination of the full passage length in the toothbrush, nevertheless permits stale dentifrice to lie in the tube 20a which is prevented in the construction shown in FIG. 15.

FIGS. 16 and 17 show a modification of the structure of FIG. 13 in which the cartridge 11 and the dentifrice-containing bag 75c are the same as in FIG. 13. The cap 33d is somewhat different however. The cap 33d, like the cap 33c in FIG. 13, is a hollow dome-shaped member having the air intake port 41, the check valve 43 and the leaf spring 45 secured to and normally closing the check valve. The plate 31d which extends across and closes the chamber of the cap differs from the plate 31c in FIG. 13 in that instead of having a central bulb-shaped configuration it has a pair of flaps 801 and 802 which in this instance are shown as being rectangular and are hinged for swinging movement about the pivot pins 803 and 804 from a closed position in the plane of the plate as shown in dotted lines in FIG. 16 to the open position shown in solid lines. In the closed position, these flaps effectively seal the chamber within the cap in which the valve 43 and leaf spring 45 are disposed. The flaps 801 and 802 are urged by the spring pressure of springs 807 and 809 to closed position. The plate 31d differs further from the plate 31c in that it is not perforated and has no opening except for the central opening controlled by the flaps 801 and 802.

The bag 75c as stated is of the same construction as in FIG. 13, having the solid thickened knob 335 at the cap end which has a narrow connecting portion 336 where the knob connects to the end of the bag. This knob is an integral part of the bag. The upper part of the knob 335 is wider than the opening 810 controlled by the flaps but the connecting portion 336 is slightly narrower than opening 810.

Before the cap is applied, the flaps are of course closed by the springs 807 and 809 to effectively seal the cap chamber. At this time, the end of the bag 75c is somewhat dome-shaped and protrudes beyond the open end of the cylinder 28. When the cap is applied, the knob 335 will force the flaps to the open position as the knob 335 is compressed and squeezed through opening 810 to the position shown. This automatically opens communication between the cap chamber in which the valve 43 is disposed and the cylinder 28 through the open space 810 on opposite sides of the knob 335. It should also be noted in FIG. 17 that the narrow connecting portion 336 is trapped in the cap between the open flaps so that after the dentifrice has been used up the bag will come out of the chamber by clinging to the cap as the cap is removed. The knob 335 can of course with manual pressure be pulled out of the space between the open flaps in order to remove and replace a used-up bag.

When the cap is applied as shown in FIGS. 16 and 17, the device may be used by squeezing the cartridge 28 as before to distribute dentifrice on the toothbrush. As the bag collapses through continued use of the dentifrice, air will replace the volume taken up by the bag each time squeezing pressure is released to cause a reduced differential pressure inside the cap sufficient to open valve 43 and permit air to enter the cylinder 28 through the space between the open flaps. In this construction, unless the bag has a means similar to the knob 335, the flaps 801 and 802 will not be opened when the cap is applied. The flaps however must be opened in order to provide a path for the air which must replace the volume of the bag of dentifrice as it collapses which air can only enter through the port 41. Hence the knob 335 by opening the flaps renders the unit fully operative. So long as the cap remains in place, the knob 335 will hold the flaps open.

What I claim as my invention is:

1. A toothbrush comprising an elongated cartridge unit and an elongated brushing unit joined end to end, said brushing unit including a shank portion having a head at the end thereof opposite said cartridge unit provided with bristles extending laterally therefrom, said cartridge unit having a chamber therein defined at least in part by a squeeezable wall, a replaceable dentifrice tube disposed in said chamber, passage means from said replaceable tube through said cartridge and brushing units to said head to convey dentifrice to said head when forced from said tube by the squeezing of said wall, said chamber having an opening in the end opposite said brushing unit which is closed by a removable cap, said tube being replaceable through said opening, cooperating interengaging means on said cap and tube enabling the removal of said tube through the opening in said chamber when said cap is removed, and check valve means in said cap for admitting air into said chamber when squeezing pressure upon said squeezable wall is released, the end of said tube adjacent said cap being sealed so that air admitted to said chamber by said check valve means will not contaminate the dentifrice in said tube.

2. The toothbrush in claim 1, wherein said cooperating engaging means comprises a member on the end of said tube adjacent said cap removably fitted in a complementary recess in said cap.

3. A toothbrush comprising an elongated cartridge unit and an elongated brushing unit joined end to end, said brushing unit including a shank portion having a head at the end thereof opposite said cartridge unit provided with bristles extending laterally therefrom, said cartridge unit having a chamber therein defined at least in part by a squeezable wall, a replaceable dentifrice tube disposed in said chamber, passage means from said replaceable tube through said cartridge unit to said head to convey dentifrice to said head when forced from said tube by the squeezing of said wall, said chamber having an opening in the end opposite said brushing unit which is closed by a removable cap, check valve means in said cap for admitting air into said chamber when squeezing pressure upon said squeezable wall is released, a wall in said cap sealing said check valve means from said chamber, and means on the end of said tube for automatically opening a passage in said wall when said cap is applied.

4. The toothbrush defined in claim 3, wherein said passage in the wall of said cap is normally held closed by a flap, and a member on the end of said tube adjacent said cap for opening said flap when said cap is applied.

5. The toothbrush defined in claim 4, wherein said member on the end of said tube comprises a knob adapted to force open said flap when said cap is applied and project into said passage without objectionably obstructing the same.

6. The toothbrush defined in claim 5, wherein said knob is so tapered as to be inserted readiy into said passage but to be withdrawn with greater effect so that when said cap is removed said tube is removed along with it thus facilitating removal of said tube from said chamber.

7. A toothbrush comprising a cartridge portion and a brushing portion, said brushing portion being provided with bristles, said cartridge portion having a chamber therein defined at least in part by a squeezable wall, a replaceable dentifrice tube disposed in said chamber, passage means from said replaceable tube to the bristles of said brushing portion to convey dentifrice to said bristles when forced from said tube by the squeezing of said wall, a removable cap closing an opening in said chamber, check valve means in said cap for admitting air into said chamber when squeezing pressure on said squeezable wall is released, a wall in said cap sealing said check valve means from said chamber, and means on the end of said tube for automatically opening a passage in said wall when said cap is applied.

* * * * *